US008596617B2

(12) United States Patent
James

(10) Patent No.: US 8,596,617 B2
(45) **Date of Patent: *Dec. 3, 2013**

(54) IMPACT ENERGY DISSIPATION SYSTEM

(75) Inventor: Dallas James, Auckland (NZ)

(73) Assignee: Axip Limited, Auckland (NZ)

( * ) Notice: Subject to any disclaimer, the term of this patent is extended or adjusted under 35 U.S.C. 154(b) by 212 days.

This patent is subject to a terminal disclaimer.

(21) Appl. No.: 12/709,257

(22) Filed: Feb. 19, 2010

(65) Prior Publication Data

US 2010/0207087 A1 Aug. 19, 2010

Related U.S. Application Data

(63) Continuation-in-part of application No. 10/572,722, filed on Nov. 6, 2006, now Pat. No. 7,699,293.

(51) Int. Cl.
*E01F 15/00* (2006.01)

(52) U.S. Cl.
USPC ..... 256/13.1

(58) Field of Classification Search
USPC ..... 256/13.1, 48, 56; 244/110 A, 110 C, 244/110 F; 404/9.1
See application file for complete search history.

(56) References Cited

U.S. PATENT DOCUMENTS

| | | | | |
|---|---|---|---|---|
| 1,722,994 | A * | 8/1929 | Burd | 403/209 |
| 1,828,349 | A | 10/1931 | Williams | |
| 2,244,042 | A | 6/1941 | Barlow | |
| 2,561,206 | A | 7/1951 | Kaspar | |
| 2,976,923 | A | 3/1961 | Hirashiki | |
| 3,204,606 | A | 9/1965 | Parr | |
| 3,350,039 | A | 10/1967 | Crater | |
| 3,537,687 | A | 11/1970 | Adelman | |
| 3,617,076 | A | 11/1971 | Attwood et al. | |
| 3,738,599 | A | 6/1973 | Borehag | |
| 3,776,520 | A | 12/1973 | Charles et al. | |
| 3,866,397 | A | 2/1975 | Koziol | |
| 3,912,404 | A | 10/1975 | Katt | |
| 3,982,734 | A | 9/1976 | Walker | |
| 4,047,702 | A * | 9/1977 | Cernia et al. | 256/13.1 |
| 4,183,317 | A | 1/1980 | Follick | |
| 4,222,552 | A | 9/1980 | Matteo, Sr. | |

(Continued)

FOREIGN PATENT DOCUMENTS

| | | |
|---|---|---|
| AU | 199674061 | 6/1997 |
| AU | 199674061 B2 | 6/1997 |

(Continued)

*Primary Examiner* — Joshua Kennedy
(74) *Attorney, Agent, or Firm* — Greer, Burns & Crain, Ltd.

(57) ABSTRACT

A guardrail includes a cable routing device providing a tortuous path for at least one tensioned cable, the cable routing device includes a bar having a rotational axis and including a cable entry port having a circumference slightly larger than the cable which passes directly therethrough when the bar is in a first non-cable gripping orientation in which the diameter of the port (diametric width) is substantially orthogonal to the longitudinal axis of the cable, and wherein rotation of the bar about the axis effectively decreases the width of the port relative to the width of the cable to create a second cable-gripping orientation which provides the tortuous path, wherein the tortuous path through the bar is due to the relative decrease in the effective diametric width of the port and this provides sufficient frictional resistance to movement in relation to the cable during impact to facilitate impact energy dissipation.

14 Claims, 6 Drawing Sheets

(56) References Cited

U.S. PATENT DOCUMENTS

| | | | | |
|---|---|---|---|---|
| 4,330,106 | A | 5/1982 | Chisholm | |
| 4,452,431 | A * | 6/1984 | Stephens et al. | 256/13.1 |
| 4,498,660 | A | 2/1985 | Brema et al. | |
| 4,655,434 | A | 4/1987 | Bronstad | |
| 4,674,911 | A | 6/1987 | Gertz | |
| 4,678,166 | A | 7/1987 | Bronstad et al. | |
| 4,681,302 | A | 7/1987 | Thompson | |
| 4,730,810 | A * | 3/1988 | Rambaud | 256/12.5 |
| 4,739,971 | A | 4/1988 | Ruane | |
| 4,844,424 | A | 7/1989 | Knudslien | |
| 5,022,782 | A * | 6/1991 | Gertz et al. | 404/6 |
| 5,039,066 | A * | 8/1991 | Stacey | 256/13.1 |
| 5,118,056 | A * | 6/1992 | Jeanise | 246/127 |
| 5,123,773 | A | 6/1992 | Yodock | |
| 5,207,302 | A | 5/1993 | Popp et al. | |
| 5,391,016 | A | 2/1995 | Ivey et al. | |
| 5,435,524 | A | 7/1995 | Ingram | |
| 5,609,327 | A | 3/1997 | Amidon | |
| 5,664,905 | A | 9/1997 | Thompson et al. | |
| 5,729,607 | A | 3/1998 | Defries et al. | |
| 5,762,443 | A * | 6/1998 | Gelfand et al. | 404/6 |
| 5,797,591 | A | 8/1998 | Krage | |
| 5,820,110 | A | 10/1998 | Beu | |
| 5,851,005 | A | 12/1998 | Muller et al. | |
| 5,921,021 | A | 7/1999 | Coates | |
| 5,967,497 | A | 10/1999 | Denman et al. | |
| 6,059,491 | A | 5/2000 | Striefel et al. | |
| 6,065,738 | A | 5/2000 | Pearce et al. | |
| 6,065,894 | A | 5/2000 | Wasson et al. | |
| 6,085,458 | A | 7/2000 | Gau | |
| 6,109,597 | A | 8/2000 | Sicking et al. | |
| 6,149,134 | A | 11/2000 | Bank et al. | |
| 6,173,943 | B1 | 1/2001 | Welch et al. | |
| 6,290,427 | B1 | 9/2001 | Ochoa | |
| 6,299,141 | B1 | 10/2001 | Lindsay et al. | |
| 6,398,192 | B1 | 6/2002 | Albritton | |
| 6,409,417 | B1 | 6/2002 | Muller et al. | |
| 6,488,268 | B1 | 12/2002 | Albritton | |
| 6,558,067 | B2 | 5/2003 | Ochoa | |
| 6,619,630 | B2 | 9/2003 | Albritton | |
| 6,719,483 | B1 * | 4/2004 | Welandsson | 404/6 |
| 6,729,607 | B2 | 5/2004 | Alberson et al. | |
| 6,863,264 | B2 | 3/2005 | Johansson et al. | |
| 6,902,150 | B2 | 6/2005 | Alberson et al. | |
| 6,926,462 | B1 | 8/2005 | Fuganti et al. | |
| 6,932,327 | B2 | 8/2005 | Alberson et al. | |
| 6,948,703 | B2 | 9/2005 | Alberson et al. | |
| 6,962,328 | B2 | 11/2005 | Bergendahl | |
| 7,086,805 | B2 | 8/2006 | Smith et al. | |
| 7,216,854 | B2 | 5/2007 | Bryan | |
| 7,234,275 | B1 | 6/2007 | Haggy et al. | |
| 7,396,184 | B2 | 7/2008 | LaTurner et al. | |
| 7,445,402 | B1 | 11/2008 | Chen | |
| 7,537,411 | B2 | 5/2009 | Yodock, Jr. et al. | |
| 7,699,293 | B2 * | 4/2010 | James | 256/13.1 |
| 7,722,282 | B2 | 5/2010 | Meidan | |
| 7,785,031 | B2 * | 8/2010 | Vellozzi et al. | 404/6 |
| 2001/0013596 | A1 | 8/2001 | Sicking et al. | |
| 2001/0048846 | A1 | 12/2001 | Ochoa | |
| 2002/0025221 | A1 | 2/2002 | Johnson | |
| 2002/0179894 | A1 | 12/2002 | Albritton | |
| 2003/0222254 | A1 * | 12/2003 | Bergendahl | 256/13.1 |
| 2004/0140460 | A1 | 7/2004 | Heimbecker et al. | |
| 2005/0036832 | A1 | 2/2005 | Smith et al. | |
| 2005/0047862 | A1 | 3/2005 | Smith et al. | |
| 2005/0063777 | A1 | 3/2005 | Smith et al. | |
| 2005/0077507 | A1 | 4/2005 | Heimbecker et al. | |
| 2005/0077508 | A1 | 4/2005 | Bronstad | |
| 2006/0013650 | A1 | 1/2006 | Meidan | |
| 2006/0017048 | A1 | 1/2006 | Alberson et al. | |
| 2006/0054876 | A1 | 3/2006 | LaTurner et al. | |
| 2006/0102883 | A1 | 5/2006 | Troutman et al. | |
| 2007/0102689 | A1 | 5/2007 | Alberson et al. | |
| 2007/0252124 | A1 | 11/2007 | Heimbecker | |
| 2008/0000062 | A1 | 1/2008 | Boltz | |
| 2009/0146121 | A1 | 6/2009 | Sharp et al. | |

FOREIGN PATENT DOCUMENTS

| | | | |
|---|---|---|---|
| CA | 2167548 | | 1/1996 |
| CA | 2167548 | | 7/1996 |
| EP | 0816568 | | 1/1998 |
| EP | 0 924 348 | A2 | 6/1999 |
| EP | 0924348 | | 6/1999 |
| EP | 1 152 104 | A2 | 7/2001 |
| EP | 1152104 | | 11/2001 |
| EP | 1619308 | | 1/2006 |
| EP | 1612333 | | 4/2006 |
| FR | 2701046 | | 8/1994 |
| FR | 2846673 | | 5/2004 |
| NZ | 528396 | | 2/2006 |
| WO | WO 96/29473 | A1 | 9/1996 |
| WO | WO 98/44203 | A1 | 10/1998 |
| WO | WO 99/32728 | A1 | 7/1999 |
| WO | 03064772 | | 8/2003 |
| WO | WO 03/064772 | A1 | 8/2003 |
| WO | 2005028757 | | 3/2005 |
| WO | WO 2005/028757 | A1 | 3/2005 |

* cited by examiner

IMPACT ENERGY DISSIPATION SYSTEM

RELATED APPLICATION

This is application is a continuation-in-part of application Ser. No. 10/572,722 filed Nov. 6, 2006 now U.S. Pat. No. 7,699,293. Priority is claimed under 35 USC §120.

TECHNICAL FIELD

This invention relates to impact energy dissipation systems and in particular, though not solely, to guardrails and/or guardrail impact heads for use in road networks and/or vehicle road lanes requiring separation by a barrier.

BACKGROUND

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET 2000 and ET plus), the slotted rail terminal (SRT), the sequential kinking terminal (SKT) and the flared energy absorbing terminal (FLEAT).

Terminal ends (that is, the end facing oncoming traffic) generally consist of one or more, often three, W shaped (in cross-section) guardrails supported by a series of both controlled release terminal (CRT) or frangible posts and standard highway guardrail posts. Generally, a cable assembly arrangement is utilised that anchors the end of the rail to the ground, transferring tensile load developed in a side-on impact by an errant vehicle to the ground anchor. Generally, the terminal ends have an impact head arrangement that will be the first part impacted by an errant vehicle during an end-on impact which is designed to spread or absorb some of the impact energy.

Some terminal ends such as the abovementioned ET, SKT and FLEAT, absorb the energy of the impacting vehicle during an end on impact by having an impact head that slides down the W shaped guardrails, extruding it and breaking away the support posts as it travels down the rails. All of the other abovementioned terminal ends work on the principal of various weakening devices in the posts and rails to allow an errant vehicle to penetrate the terminal end in a controlled manner and prevent the rails from spearing the vehicle or the vehicle from vaulting or jumping over a relatively stiff terminal end.

All of the abovementioned guardrail terminal ends are considered to be gating, that is, if impacted between the impact head and the "length of need" (where the "length of need" is considered to be the distance from the terminal end to where the guardrail will redirect a vehicle during an angled impact) during an angled impact, the terminal end will gate and allow the errant vehicle to pass to the back side of the terminal end. However, this gating effect may have undesirable or unsafe results, and preferably an improved or safer or varied energy absorbing system is utilised to control errant vehicle barrier/guardrail impacts.

It is therefore an object of the present invention to provide a guardrail and/or guardrail impact head which will go at least some way towards addressing the foregoing problems or which will at least provide the industry with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

SUMMARY

Accordingly, in a first aspect, the invention may broadly be said to consist in an impact head for a guardrail comprising:

a cable routing means which forms a tortuous path through which a cable is adapted to be threaded.

The cable routing means for use in the impact head according to the invention may be any member through which a cable may pass and that provides a tortuous path through which said cable may be threaded. The tortuous path may be any path that provides sufficient friction to slow down the movement of the impact head during a vehicle impact.

The tortuous nature of the passage through the cable routing means may be provided by one or more turns through which a cable may be threaded.

In preferred embodiments the tortuous nature of the passage through the cable routing means may be provided by one or more turns of greater than substantially 90° through which a cable may be threaded.

In preferred embodiments the cable routing means includes at least one substantially 180° turn.

In particularly preferred embodiments the cable routing means includes at least one substantially S or Z-shaped turn.

In some embodiments the cable routing means may be adapted so that in use and during a collision or impact with the impact head, the cable is forced through the cable routing means, where resistance to cable movement provided by the tortuous cable path substantially facilitates impact energy dissipation.

In particularly preferred embodiments, the cable routing means is adapted so that when a predetermined level of force is applied to the impact head the one or more cables are forced through the cable routing means, where resistance to cable movement provided by the tortuous cable path limits any movement of the impact head caused by the force.

In some embodiments, the cable routing means may include a member having two or more cable entry ports provided therein through which a cable may be threaded.

Preferably, the cable routing means comprises a bar member having a longitudinal axis and including a cable entry port adapted to allow a cable to pass directly therethrough when said bar member is in a first non-cable-routing orientation, and wherein upon rotation of said bar member through at least 90° about said longitudinal axis, a second cable-routing orientation is reached.

The bar member may be secured in the second orientation by locking means in the form of bolts, screws and the like.

In preferred embodiments, the cable may be anchored at one point, pass through the impact head according to the invention and then be anchored at another point such that the impact head is substantially between the two anchor points.

The cables may be anchored to any object capable of providing sufficient inertia to restrict cable movement relative to the ground.

In preferred embodiments, the cables may be either directly or indirectly anchored to the ground.

The impact head according to the present invention may be manufactured from any resilient or impact resistant material or composite of materials of any nature.

In preferred embodiments, the impact head and/or the guardrail may be constructed from steel.

In preferred embodiments of the impact head according to the present invention, one or more cables may be threaded through the cable routing means. These cables may preferably be tensioned and anchored at one or more points. In those embodiments where the cable(s) is/are anchored, they may be preferably anchored at one end via a rail and/or a support post of the guardrail.

In one particularly preferred embodiment, the one or more cables may be anchored at one end in a position down-road of the proposed traffic flow away from the impact head and the other end(s) may be anchored to a rail and/or a support post substantially up-road of the said impact head.

In one preferred embodiment, the cable may be high-tensile steel.

In preferred embodiments, the tension of one or more cables may be adjusted so as to give a suitable resistance to movement.

In a second aspect, the present invention also provides a guardrail including:

- a plurality of spaced apart support posts at least some of which have a predetermined failure load,
- a plurality of rails slidably interconnected and mounted directly or indirectly to said posts,
- at least one cable provided along at least a part of the length of said slidably interconnected rails wherein at least one end of said at least one cable is fixed in relation to the ground, and
- an impact head according to the present invention positioned at one end of the slidably interconnected rails and through which at least one cable is threaded.

In some embodiments, the at least one cable may be located within recesses within the plurality of a slidably interconnected rails.

Preferably, the slidably connected rails telescope upon an impact substantially in-line with the longitudinal direction of the slidable rails.

Preferably, the rails are separated from the support posts by a spacer.

Preferably, frangible fasteners connect a plurality of rails to one another and/or to said posts.

In a third aspect, the invention may broadly be said to consist in a guardrail comprising:

- a plurality of spaced apart support posts, at least some of which have a predetermined failure load,
- a plurality of rails slidably interconnected and mounted directly or indirectly to said posts,
- at least one cable provided along at least a part of the length of said slidably interconnected rails wherein each end of said at least one cable is fixed in relation to the ground, and
- an impact head in accordance with the first aspect positional at one end of the slidably interconnected rails and through which at least one of said at least one cable is routed in said tortuous path.

Preferably, the end of at least one cable located farthest from the cable routing means is anchored to a rail and/or a support post.

Preferably, the impact head is mounted to a first support post.

Preferably, the impact head is mounted to a rail.

Preferably, the cable routing means may be mounted to a first support post or to a rail.

Preferably, the cable routing means is connected to an end of a plurality of interconnected rails.

Preferably, rotation of the bar member from said first orientation to said second orientation ensures that the cable follows a tortuous pathway.

In a further aspect, the present invention also relates to a method of constructing a guardrail including the steps of slidably interconnecting a plurality of rails and attaching them to posts, positioning an impact head according to the invention at one end of the slidably interconnected rails, threading at least one cable through the impact head and anchoring the cable to the ground.

In preferred embodiments, the method of constructing a guardrail may include the steps of:

- installing a plurality of support posts,
- a plurality of rails slidably interconnected and mounted directly or indirectly to said posts, and
- fixing at least one end of at least one cable to the ground, and
- positioning an impact head according to the present invention at one end of the slidably interconnected rails and threading at least one cable through it.

BRIEF DESCRIPTION OF THE DRAWINGS

Further aspects of the present invention will become apparent from the following description which is given by way of example only and with reference to the accompanying drawings in which.

DETAILED DESCRIPTION

This invention is designed to be a substantially non-gating guardrail, meaning that at any point along the side of the guardrail from the terminal end onwards, an impacting vehicle on an angled collision may be substantially redirected away from its initial impact trajectory. It is also designed to substantially absorb energy during an end on impact to the terminal end.

"Gating" is a term used within the guardrail industry to refer to sections of guardrail which are unable to withstand high impact side angle collisions, and significant guardrail deformation or ultimate failure or breakage may occur.

Figure 1B:
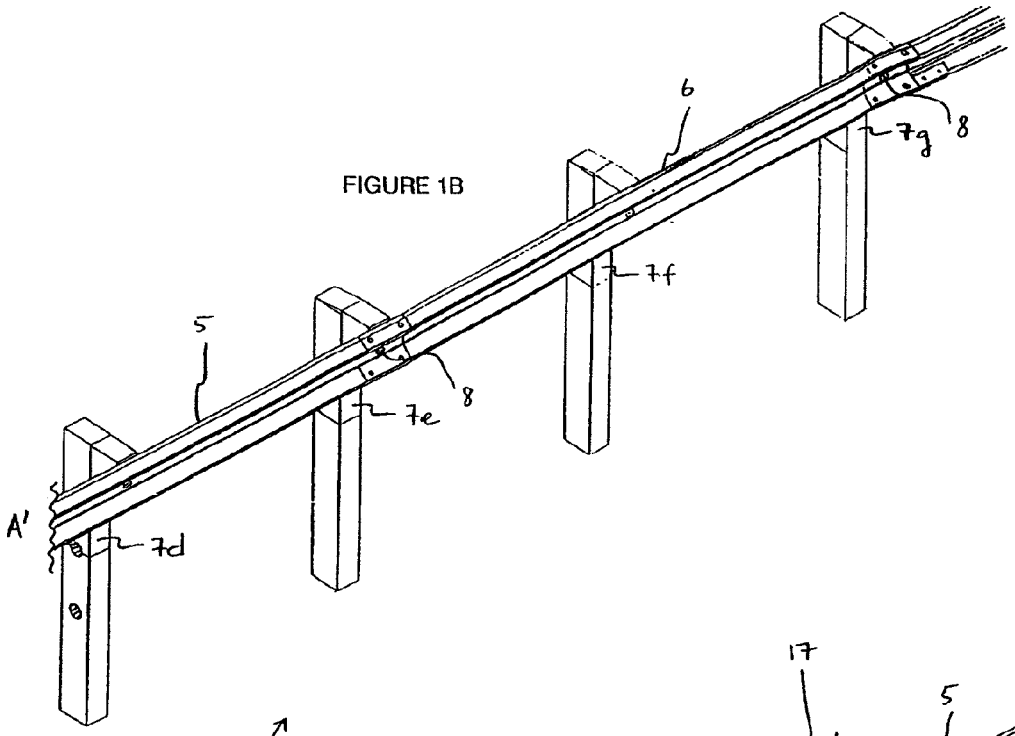
FIGS. 1*a* and 1*b*: are perspective views from the front or roadway side of one embodiment of a guardrail according to the present invention.
Figure 1A:
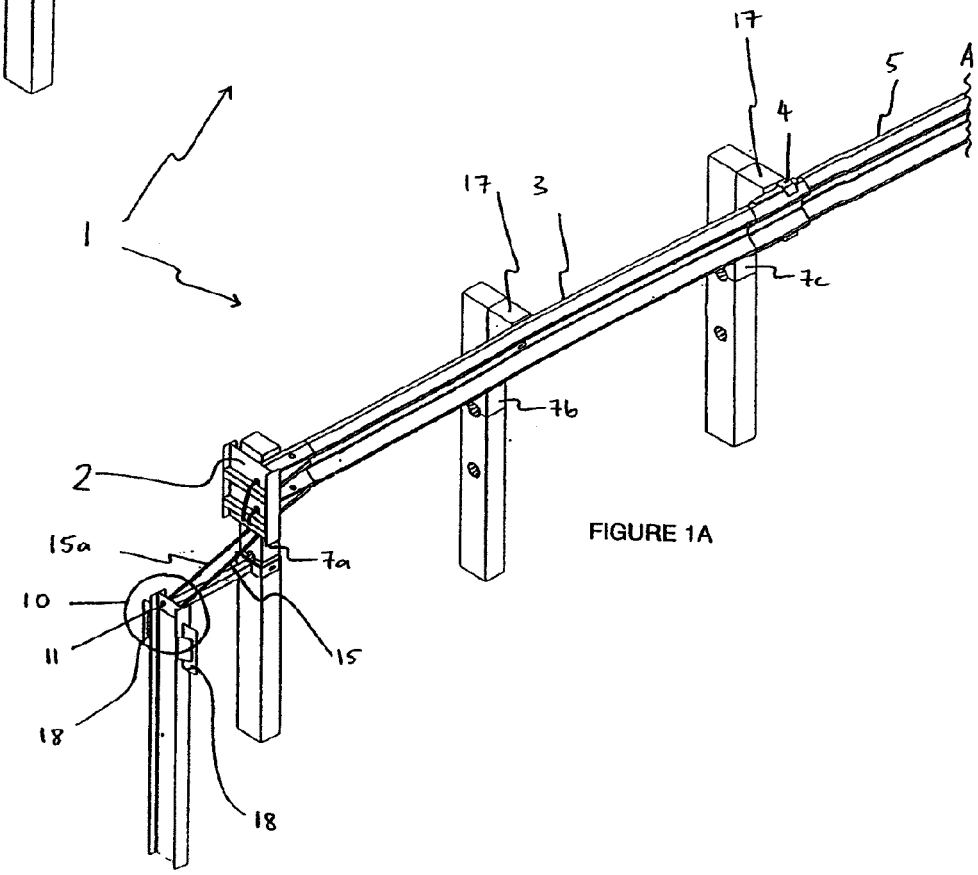
Figures 2A, 2B:
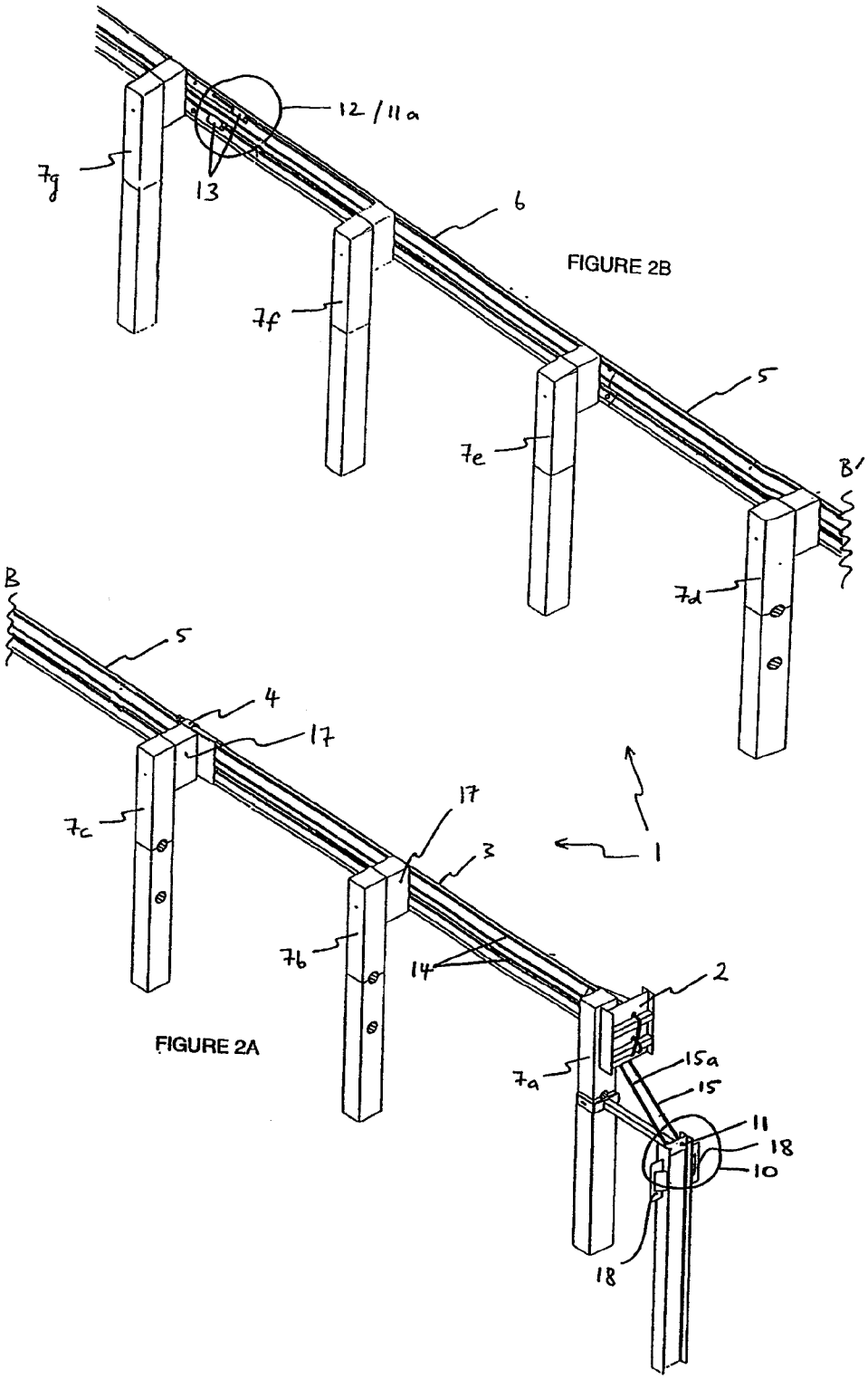
FIGS. 2*a* and 2*b*: are perspective views from the rear of the guardrail of FIGS. 1*a* and 1*b*.

For the purposes of this illustrative description, FIGS. 1A and 1B will be referred together as FIG. 1; similarly FIGS. 2A and 2B will be referred to as FIG. 2. The guardrail 1 shown has been split into two sections for illustrative purposes only, and sections A and A' in FIGS. 1*a* and 1*b*; and the same sections are labelled B and B' in FIGS. 2A and 2B should be joined to show an embodiment the guardrail according to the present invention.

In a first embodiment of the present invention, and with reference to FIGS. 1 and 2 there is provided a guardrail 1 with a cable routing means 2 at the terminal end. The cable routing means 2 may form part of an impact head (where an impact head is an additional guardrail bumper used to initially absorb some impact energy).

The cable routing means 2 (and optionally impact head) may be bolted to the first rail 3, at the other end of which is connected an impact slider device 4. The impact slider device 4 may facilitate the sliding of the first rail over each subsequent rail, thereby providing substantial telescoping ability to the guardrail, (1) with each rail overlapping the next rail to enable this process during an end-on impact. First rail (3) telescoping over second subsequent rail (5) and second subsequent rail (5) telescoping over further subsequent rail (6) during an end-on impact. It would be obvious to a person skilled in the art that any number of preceding rails could telescope over a further subsequent rail (not shown), therefore the number of telescoping rails should not be seen as being limiting. The impact slider assembly (4) may substantially surround the first rail (3) and advantageously includes an impact slider panel (33), most clearly shown in FIG. 10.

The rails (3, 5, 6) may be supported by upstanding CRT (controlled release terminal) (7*a*, 7*b*, 7*c*, 7*d*) and/or frangible posts and/or posts of a predetermined failure load or any combination of these post types which will now be collectively referred to by designation (7). The rails (3, 5, 6) may be directly attached (not shown) to the posts, (7) or alternatively may be indirectly attached via spacers (17) or similar block type arrangement.

The impact slider assembly (4) may also be used to detach or facilitate the disjointing or disconnection of a connection such as a frangible bolt (8) between a rail (3, 5, 6) and a CRT (7). Preferably the impact slider assembly (4) is a structural member of suitable strength that allows the bolts (8) (or similar connector) connecting rail (5) to posts (7*c,d,e*); or rail (5) to rail (3) or the next rail (6); to either be severed from the rail or pulled or bent free from the rail connection. The rails (3, 5, 6) may be connected to each other separately from support post connections (8). Depending on the strength and/or impact force generated by an impact with guardrail impact head (24) and subsequently the impact slider assembly (4), the bolts (8) may be made of materials such as plastics or high density plastic or other composite materials, or frangible bolts, which are more likely to fail and shear off from the post connection (or from the rail to rail connection) by an impact from the impact slider assembly (4), than a side angle impact with the guardrails (3, 5, 6). This may be an advantageous feature allowing the impact slider assembly (4) to operate and shear off post holding rail bolts (8), whilst at the same time providing resistance to side angle impacts and reducing the likelihood of the guardrail gating.

A cable (or cables) 15*a*, 15*b* has an end 10 which may be attached to a soil anchor assembly (9) or otherwise fixed adjacent (not shown) the impact head (24). The other cable end (11*a*, 11*b*) extends to a second anchor or fixed point, which may be a further soil anchor assembly (not shown), or alternatively, may be an anchoring assembly attached to a non-frangible support post (not shown) or non-telescoping rail (16). The cable (15*a*, 15*b*) may be anchored by cable brackets (13*a*, 13*b*) to the posts (7*a-g*) or a non-telescoping rail (16) or by any suitable cable anchoring system, such as bolts and welds or the like. The soil anchor assembly (9) may include a sunken post (or I-beam) with flares or winged portions (18) extending outwards from the post to engage with greater soil area and providing increased resistance to movement of the anchor assembly (9) as a result of an impact with the guardrail (1).

The embodiment shown in FIGS. 1 and 2 of a guardrail (1) consists of a soil anchoring system (9) at the impact head (24) end of the guardrail (1) and provides a means to attach two cables (15*a*, 15*b*) thereto. The cables (15*a*, 15*b*) are preferably threaded in a substantially S-shape (or Z-shape), through the cable routing means (2), which may be a steel plate bolted to the impact head (24) (or first post 7*a*). At the junction of the first (3) and second (5) rails (or sections of rails), there is an impact slider assembly (4) that fits over the end of the first rail (3) and into which the next rail (5) may slide.

The term up-road will for the purposes of this specification be used to describe a position on one side of a road that is located some distance further along that one side of the road in relation to a vehicle correctly travelling on said side of the road. It would be apparent that given this definition, that to vehicles travelling correctly on opposite sides of the same road, up-road will be in opposing directions.

The cables (15*a*, 15*b*), after being threaded through the cable routing means (2), are positioned in a hollow or recess (14) in the back side of the length of the rail (3, 5, 6) (for example, the rail may be a W-shaped extrusion, the lower portion of the W preferably forming the front or road side of the rail, the cable (15*a*,) being located in one channel formed by the W and cable (15 *b*) being located in the other). The cables (15*a*, 15*b*) may extend until a point (11*a*, 11*b*) where they may be anchored to the rail (13*a*, 13*b*) (or post, or other anchoring means) at a post up-road of the cable routing means (2) using one or more cable brackets (13*a*, 13*b*) or other connecting and/or cable fixing means. Such means may be screws, bolts, welded joints or other suitable devices enabling substantially secure cable anchoring. The cable (15*a*, 15*b*) may be tensioned, although this is not essential for the present invention to operate.

Figure 4:
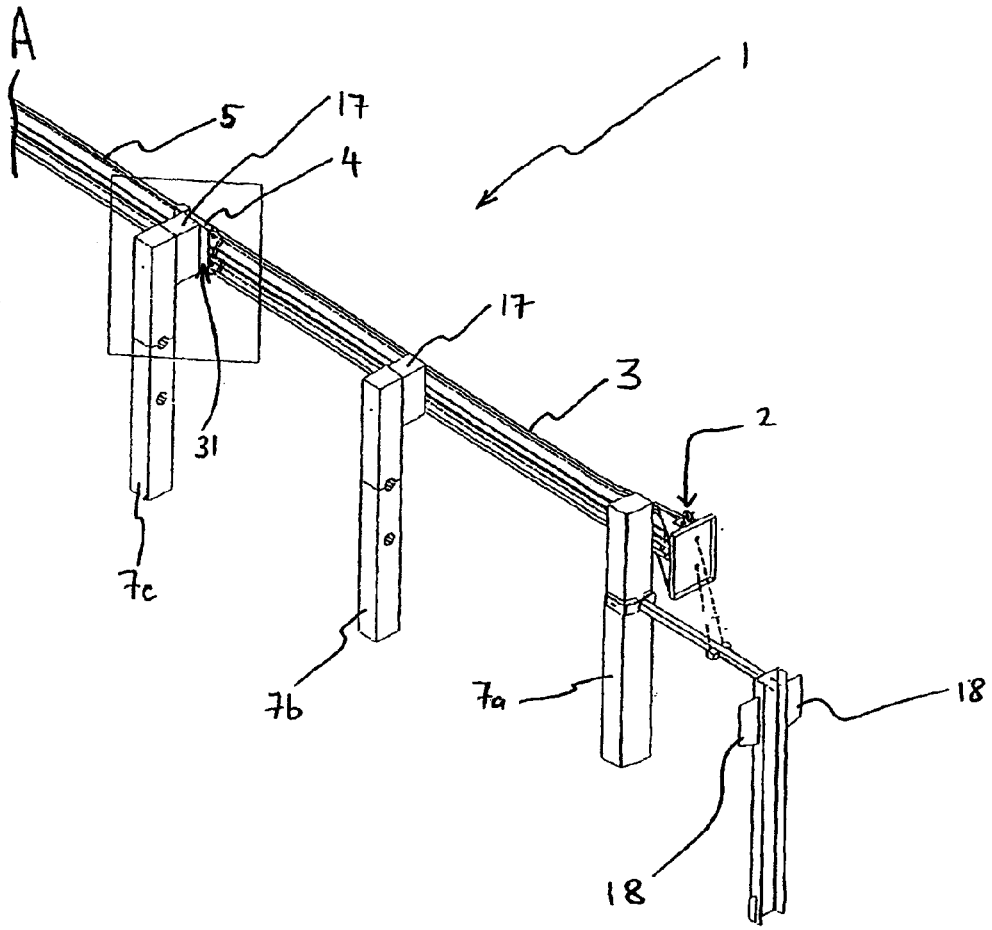
FIG. 4: is an alternative embodiment of the guardrail of FIG. 2*a*.
Figure 5:
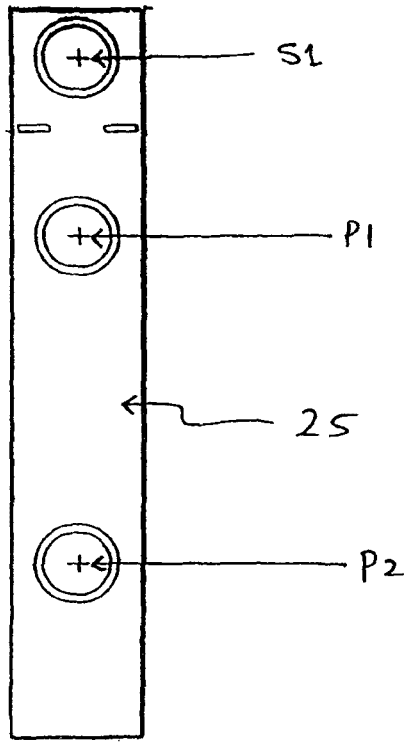
FIG. 5: is a front elevation view of one embodiment of a cable routing means according to the present invention.

An alternative embodiment of the guardrail is shown in FIG. 4. The guardrail 24 includes: at least one cable routing means through which a cable is threaded in a tortuous path and which thereby provides resistance to cable movement therethrough. Ideally, the path of the cable through the cable routing means includes at least one substantially 180° turn, or is in a substantially S or Z-shape.

Advantageously, during a collision, or impact, with the impact head (24), the at least one cable is forced through the cable routing means (2), where resistance to cable movement substantially facilitates impact energy dissipation.

Figure 3:
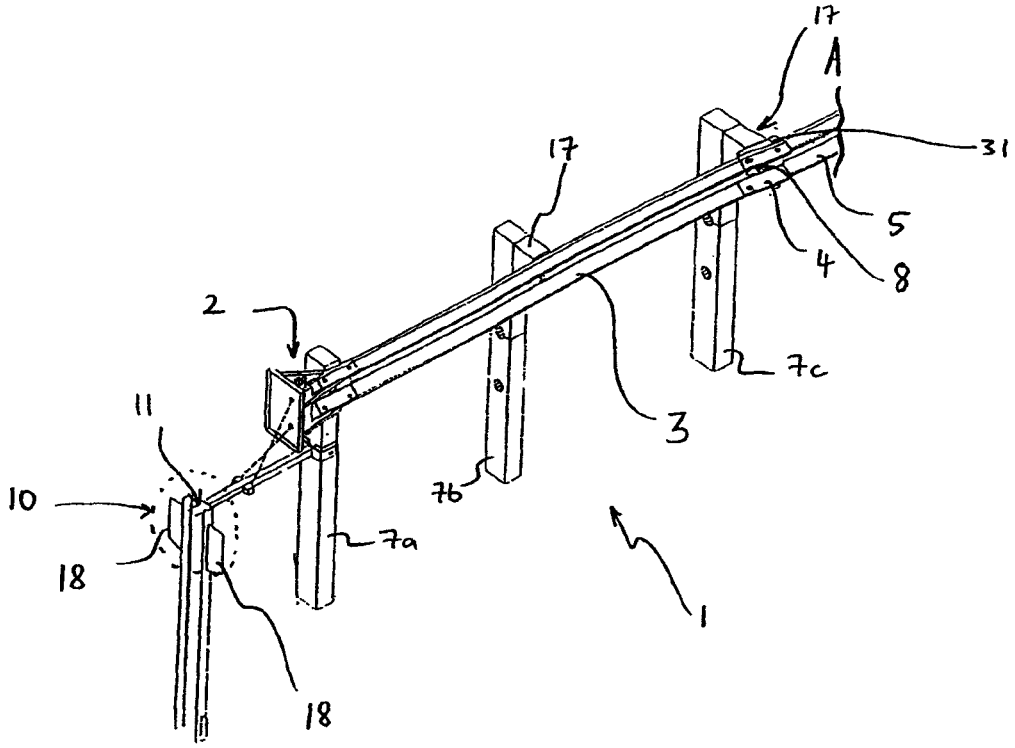
FIG. 3: is an alternative embodiment of the guardrail of FIG. 1*a*.
Figure 6B:
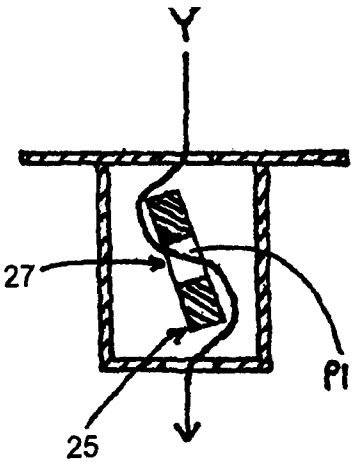
FIG. 6B: is a cross sectional schematic plan view illustrating the rotation through which the bar member of the cable routing means of FIG. 6A moves to a second cable routing orientation with the path of the cable indicated by arrow Y.
Figure 6A:
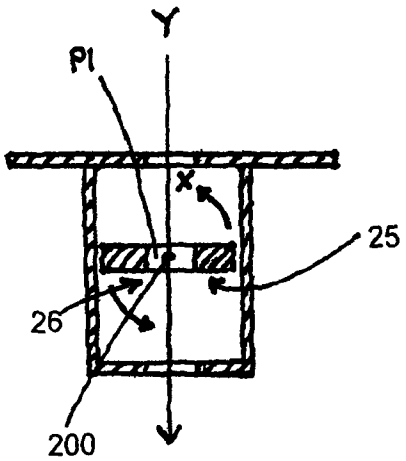
FIG. 6A: is a cross sectional schematic plan view of the bar member of the cable routing means of FIG. 5 when in a non-cable routing orientation with the path of the cable indicated by arrow Y.

The cable routing means (2), as most clearly illustrated in FIGS. 3 and 4, may be a planar bar member (25) adapted to receive and allow at least one cable (15, 15*a*) to pass therethrough via cable entry ports (P1, P2). The planar bar member (25) being rotatable about its longitudinal axis between a non tortuous orientation, as shown in FIG. 6*a*, and a tortuous orientation, as shown in FIG. 6*b*. The tortuous orientation forming a tortuous cable path which provides resistance to cable movement therethrough, such as is illustrated in FIG. 6*b*.

In an alternative embodiment of the impact head 100, as illustrated in FIGS. 3, 4, 5, 6*a* and 6*b*, a bar member (25) can be provided with a cable entry port or ports (P1, P2) adapted to receive and allow at least one cable to pass directly therethrough, when said bar member is in a first non-cable-routing orientation (26), the cable path indicated by arrow Y. Subsequently, upon rotation of the bar member (25) about its longitudinal axis (substantially perpendicular to the cables length) through at least 90°, a second cable-routing orientation (27) is reached. Advantageously, the bar member (25) may be secured in the second orientation by locking means (not shown), such as by bolts or screws. The rotation of the bar member (25) from said first orientation (26) to the second orientation (27) ensures that the at least one cable follows a tortuous pathway, the tortuous cable path indicated by arrow Y in FIG. 6*b*. The rotation of the bar member (25) may be undertaken, for example by a crowbar inserted into a slot (51) and then an angular or rotational force applied. This is illustrated more clearly in the schematic drawings of FIGS. 6*a* and 6*b* where the bar 25 rotates about pivot point 200 in the direction of arrow X to form the tortuous path.

In use, energy from a head on impact with the impact head (24) is initially substantially absorbed by support post (7*a*), which may subsequently fail, preferably substantially at or near ground level. For example the first support post (7*a*) would normally be impacted at or by the impact head (24), and absorb energy before preferably failing (that is, being broken). Should a support post (7*a*-*g*) fail and be broken off at a height substantially above ground level (not shown) the impacting vehicle may collide with the broken post which may result in more severe impact energy absorption (possibly resulting in vehicle occupant damage due to sudden movement arrest).

Preferably, the guardrail (1) employs energy absorption/dissipation systems which substantially control an impacting objects momentum and directional motion. For example, energy may be absorbed or dissipated by the friction between the cable (15*a*, 15*b*) and cable routing means (2). When the guardrail (1) is impacted end on (that is, in the substantially longitudinal direction of the guardrail and impacting the impact head (24) initially), the whole of rail (3), the impact head (24), cable routing means (2) and the impact slider assembly or part thereof (4) move in a telescoping manner over rail (5) and then subsequent up-road rails, such as rail (6). Energy is absorbed by the friction of the cables (15*a*, 15*b*), which are fixed to a soil anchor (9) or similar located substantially down-road of the impact head, the cable(s) (15, 15*a*) running through the cable routing means (2), wherein the threaded cable configuration through the cable routing means (2) follows a tortuous pathway.

Preferably, as the cable routing means (2) is attached to, or forms an integral part of an impact head (24), as the impact head (24) and cable routing means (2) move (as a result of an end-on impact with the impact head (1)), up road from the cable anchor point (11), the cable routing means (2) is effectively forced to move along the cable(s) (15*a*, 15*b*), whilst the cable(s) (15, 15*a*) remain substantially stationary as a result of being fixed at each of their ends. In doing so, the cable is forced through a number of bending movements created by the routing configuration in the cable routing means (2). Preferably, the cable (15*a*, 15*b*) used has substantial resistance to flexing (such as steel cable), and energy is dissipated from the impact and imparted to energy used to bend the cable.

Additionally, as the cable routing means (2) moves along the cable(s) (15 and 15*a*), the cable is forced to run in surface-to-surface contact with the cable routing means (2), which preferably results in additional frictional energy dissipation. In an even further alternative embodiment, the cable routing means (2) may be in the form of a sleeve (not shown) fitted around the cable (15, 15*a*) which is snug around the cable and provides frictional resistance to relative movement of either the sleeve or cable.

In an even further preferred energy dissipation system, the friction created by the impact slider assembly (4) (and rails 3, 5, 6) telescoping over one another during an impact event may help to absorb energy.

Energy from a side angle impact with the guardrail 1 is absorbed by the flexion and/or deformation (whether by elastic or plastic deformation) of the rails (3, 5, 6), as well as by the tensile forces created in the cable(s) 15, 15*a* (which may help the rails to resist flexion and/or deformation).

Preferably, the impacting object is redirected away from the guardrail 1 and the forces generated by the impact are distributed throughout the rails (3, 5, 6) and cables (15*a*, 15*b*) either by deformation or tension generated in the cables (15*a*, 15*b*) and subsequently redirected to the cable fixing point (11, 11*a*).

Preferably, a number of support posts (7*a*-7*g*) may be frangible or of a predetermined failure load which fail or substantially deform, consequently absorbing further impact energy.

Preferably an object, such as a vehicle, involved in a side angle impact is substantially redirected away from the guardrail (1), and back onto the road, and the rail (3, 5, 6) is restrained from "gating" by the further tension created in the cables (15*a*, 15*b*) by the impacts induced lateral cable (15*a*, 15*b*) movement.

Preferably, the guardrail as described above may be utilised in applications where protective barriers are required to separate vehicle traffic flow from each other, or safety to pedestrians from vehicles, or even to protect vehicles running off roads. It is desirable that the guardrail as described provides a non-gating design and which re-directs an errant vehicle from its correct path back onto a road or at least away from pedestrians on a footpath.

The guardrail as described goes at least some way toward facilitating a system for controllably slowing a vehicle during an end-on barrier impact, as well as some way towards preventing the guardrail from gating during a side angled impact. It is also preferable that the "length of need" is substantially reduced compared to various existing technologies, and may most preferably have a length of need of almost zero distance.

The guardrail as described may be utilised to form a part of whole of a guardrail system, although this system in particular may be applied to the terminal ends of a required guardrail or barrier or be substantially retrofittable to existing guardrails.

Aspects of the present invention have been described by way of example only and it should be appreciated that modifications and additions may be made thereto without departing from the scope of the appended claims.

The invention claimed is:

1. A guardrail or other impact energy absorbing apparatus including at least one cable, the guardrail comprising: a cable routing means configured to provide a tortuous path for the at least one cable, wherein the cable routing means comprises a housing inside of which is housed a bar member having a rotational axis and including a cable entry port defining at least a portion of a cable route having a longitudinal axis, the cable entry port configured to have a circumference slightly larger than that of the at least one cable for which the tortuous path is to be provided, the cable entry port having a first non-tortuous orientation in which the bar member is in a first non-rotated position and wherein the at least one cable is threaded through the cable route, and wherein rotation of said bar member about the bar member's rotational axis within the housing orientates the cable entry port to a second position wherein the longitudinal axis of the cable route is angled away from the longitudinal axis of the at least one cable to create a second tortuous orientation which provides a tortuous path in which the at least one cable is retained, wherein the tortuous path through the cable route is due to a relative decrease in the diametric width of the cable entry port relative to the longitudinal axis of the at least one cable.

2. The guardrail or other impact energy absorbing apparatus according to claim 1 wherein the cable routing means includes a member having two or more cable entry ports through which the at least one cable may be threaded.

3. The guardrail or other impact energy absorbing apparatus according to claim 1 which includes one or more cables threaded through the cable routing means.

4. The guardrail or other impact energy absorbing apparatus according to claim 3 further comprising an impact head/face wherein the cable routing means is configured so that when a force is applied to the impact head/face the cables are forced through the cable routing means, such that resistance to cable movement provided by the tortuous cable path limits movement of the impact head/face caused by the force.

5. The guardrail or other impact energy absorbing apparatus according to claim 3 wherein the one or more cables are under tension.

6. The guardrail or other impact energy absorbing apparatus according to claim 3 wherein at least one end of the one or more cables is anchored to a point remote of the guardrail/apparatus.

7. The guardrail or other impact energy absorbing apparatus according to claim 6 wherein one end of the one or more cables is anchored to a point remote of the guardrail/apparatus and the remaining end of the cables is anchored to a rail and/or a support post.

8. The guardrail or other impact energy absorbing apparatus according to claim 7 wherein an impact head/face is positioned substantially between the two anchor points.

9. The guardrail or other impact energy absorbing apparatus according to claim 1 wherein the cable routing means is configured to provide a cable route having at least one substantially 45° to 180° turn.

10. The guardrail or other impact energy absorbing apparatus according to claim 1 wherein the cable routing means is configured to provide a cable route having at least one substantially S or Z-shaped portion.

11. The guardrail or other impact energy absorbing apparatus according to claim 1 wherein the cable routing means is configured to provide a cable route having at least one turn.

12. The guardrail or other impact energy absorbing apparatus according to claim 1 wherein the tension of the at least one cable is adjusted so as to give a suitable resistance to movement.

13. A cable routing means including at least one cable, the cable routing means configured to provide a tortuous path for the at least one cable, wherein the cable routing means comprises: a housing inside of which is housed a bar member having a rotational axis and including a cable entry port defining at least a portion of a cable route having a longitudinal axis, the cable entry port configured to have a circumference slightly larger than that of the at least one cable, the cable entry port having a first non-cable gripping orientation when the bar member is in a first non-rotated position, in which the diameter of the port is substantially orthogonal to the longitudinal axis of the at least one cable and wherein the at least one cable is threaded through the cable routing means, and wherein rotation of said bar member within the housing about the bar member's rotational axis effectively decreases the width of the port relative to the longitudinal axis of the cable to create a second cable-gripping orientation which provides a tortuous path in which the at least one cable is retained, wherein the tortuous path through the bar is due to the relative decrease in the diametric width of the port relative to the longitudinal axis of the cable and this provides frictional resistance to movement in relation to the at least one cable being pulled through the cable route, in use, during impact to thereby facilitate impact energy dissipation.

14. A vehicle impact energy dissipation system including at least one cable, the system comprising:

a guardrail;

a bar member rotatably mounted to the guardrail on a rotational axis of the bar member, the bar member including a cable entry port defining at least a portion of a cable route having a longitudinal axis, the cable entry port configured to have a circumference slightly larger than that of the at least one cable, the cable entry port having a first non-tortuous orientation in which the bar member is in a first non-rotated position and wherein the at least one cable is threaded through the cable route, and wherein rotation of said bar member about the bar member's rotational axis orientates the cable entry port to a second position wherein the longitudinal axis of the cable route is angled away from the longitudinal axis of the at least one cable to create a second tortuous orientation which provides a tortuous path in which the at least one cable is retained, wherein the tortuous path through the cable route is due to a relative decrease in the diametric width of the cable entry port relative to the longitudinal axis of the cable.

* * * * *